United States Patent [19]

Johnston

[11] 4,075,943

[45] Feb. 28, 1978

[54] HIGH SPEED ACTUATOR FOR IMPACT LINE PRINTERS

[75] Inventor: Ross W. Johnston, Norristown, Pa.

[73] Assignee: Sperry Rand Corporation, New York, N.Y.

[21] Appl. No.: 624,501

[22] Filed: Oct. 21, 1975

Related U.S. Application Data

[63] Continuation of Ser. No. 449,866, March 11, 1974, abandoned.

[51] Int. Cl.[2] ..... B41J 9/02

[52] U.S. Cl. ..... 101/93.48; 101/93.02

[58] Field of Search ..... 101/93.14, 93.28, 93.29, 101/93.30, 93.34, 93.48; 335/270, 250; 336/61

[56] References Cited

U.S. PATENT DOCUMENTS

| | | | |
|---|---|---|---|
| 3,266,418 | 8/1966 | Russo | 101/93.02 |
| 3,374,452 | 3/1968 | Judd | 336/61 X |
| 3,418,928 | 12/1968 | Ponzano | 101/93.02 X |
| 3,513,773 | 5/1970 | Ponzano | 101/93.33 |
| 3,605,611 | 9/1971 | Korkel et al. | 101/93.33 |
| 3,636,868 | 1/1972 | Johnston et al. | 101/93.02 X |
| 3,726,217 | 4/1973 | Herbert | 101/93.33 |
| 3,734,012 | 5/1973 | Huggins | 101/93.29 X |
| 3,818,398 | 6/1974 | Barbier et al. | 336/61 X |

*Primary Examiner*—Edward M. Coven
*Attorney, Agent, or Firm*—John B. Sowell

[57] ABSTRACT

A high-speed fast acting actuator for an impact printing mechanism. The actuator has an improved high-strength low-mass actuating arm made of magnetic material. The actuating arm comprises a uniform thickness center lever and plates of magnetic material attached at the moment arm.

3 Claims, 3 Drawing Figures

HIGH SPEED ACTUATOR FOR IMPACT LINE PRINTERS

This is a continuation of application Ser. No. 449,866 filed Mar. 11, 1974, now abandoned.

BACKGROUND OF THE INVENTION

This invention relates to improvements in impact printing mechanisms; more particularly, the invention relates to an improved low-mass high-speed actuating mechanism for driving fast-acting impact print hammers for a high-speed impact printer.

DESCRIPTION OF THE PRIOR ART

The most advanced high-speed impact printers are designed for use as output devices in computing systems. High-speed impact printers are usually classified by the manner in which the type is presented to the record media regardless of the type of actuator employed, because the same actuator may be employed with various impact printing systems.

Actuators for driving print hammers must create enough impact force to produce multiple copies in a record media. The force required to make multiple copies has been found to be substantially constant and is independent of the force producing means. Heretofore, attempts were made to increase the speed of printing of impact printers by first increasing the speed of presentation of the type font to the record media. It was found that the increased speed of the type font required a proportional increase in the speed of movement of the print hammers. The increase in the speed of movement of the print hammers was accomplished by increasing the speed of movement of the actuator and the actuating arms. The actuators were often made larger in order to generate higher forces and were made stronger in order to accept the higher forces and increases of energy input required for faster action. It was found that the increase in the speed of movement of the print hammers also increased the available impact forces of the print hammers beyond that which was desired. Heretofore, it was common practice to provide spring means and dampers and/or snubbers which would reduce the impact forces of the print hammers. The impact forces of these prior art print hammers were further reduced by increasing the retraction force or the return spring force in the system.

Ordinarily, a small increase in printing speed in prior art printing systems would result in faster hammer speeds and the reduced time of impact could be accomplished by damping. When large increases in printing speeds are required, larger actuators were designed in order to increase the velocity of the print hammers and decrease the impact time. When higher mass hammers were employed, the hammer speeds could be reduced while maintaining the same or approximately the same impact printing force. The systems employing higher mass print hammers raised the time of impact to the point where smearing became a problem or even a limitation to the printing speed.

High-speed impact printers employing moving type behind a record media are referred to as back printers. The print hammer strikes the record media from the front and should retract immediately before the moving type causes a smear. When the moving type is on a drum or disk, the type carrier acts as a rigid anvil or backup to compress the record media between the hammer and the type. When the moving type is in the form of a flexible band, the moving band type carrier creates a film of air between the back of the band and the backup anvil. This cushion or film of air must be collapsed by the print hammer force before all copies of the record media are properly impacted.

Band type back printers require higher inertia forces to produce the same print force as a drum printer. Band type back printers can require greater movement of the print hammers than drum printers; accordingly, the time of impact and the cycle time is generally greater than for drum type printers. For these and other reasons, impact printers employing flexible moving bands of type have not approached the speed of printing accomplished by drum type printers.

There is a continuing need to provide impact printers for line printing which will produce multiple copies on visual record media because computers can produce signal data at speeds far in excess of known printing speeds. Most high-speed printers and high-speed actuators for line printers are large, expensive, complex to assemble and difficult to repair.

Accordingly, it is a primary object of the present invention to provide a reliable high-speed actuator for an impact printer of the moving band back printing type.

It is another object of the present invention to provide a small actuator having a thin central actuating lever of very low mass for producing extremely high velocities and cycle times.

It is another object of the present invention to provide means for adjusting both the force exerted by the actuator and the flight time of the driven print hammer.

It is yet another object of the present invention to provide a novel actuating lever arrangement for a plurality of actuators.

In accordance with these and other objects of the present invention, there is provided an actuator having a high energy coil mounted on the actuator frame opposite the moment arm of a low-mass and high-strength actuating lever. The actuating lever comprises a uniform thin central lever of magnetic material supporting plates of magnetic material on its moment arm.

DETAILED DESCRIPTION OF THE INVENTION

Figure 1:
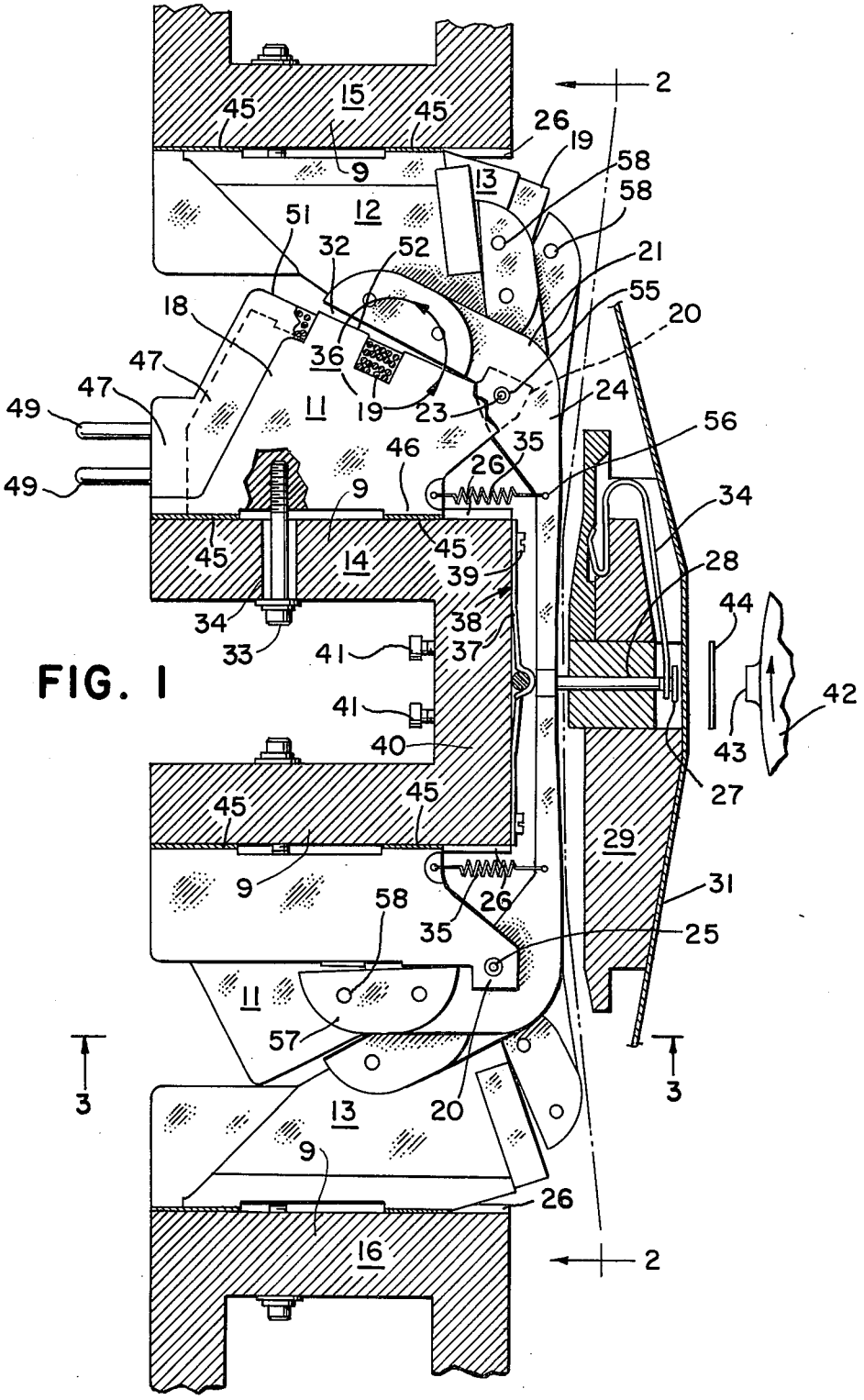
FIG. 1 is a partial section in elevation showing the mounting of the actuators opposite a print hammer assembly.
Figure 2:
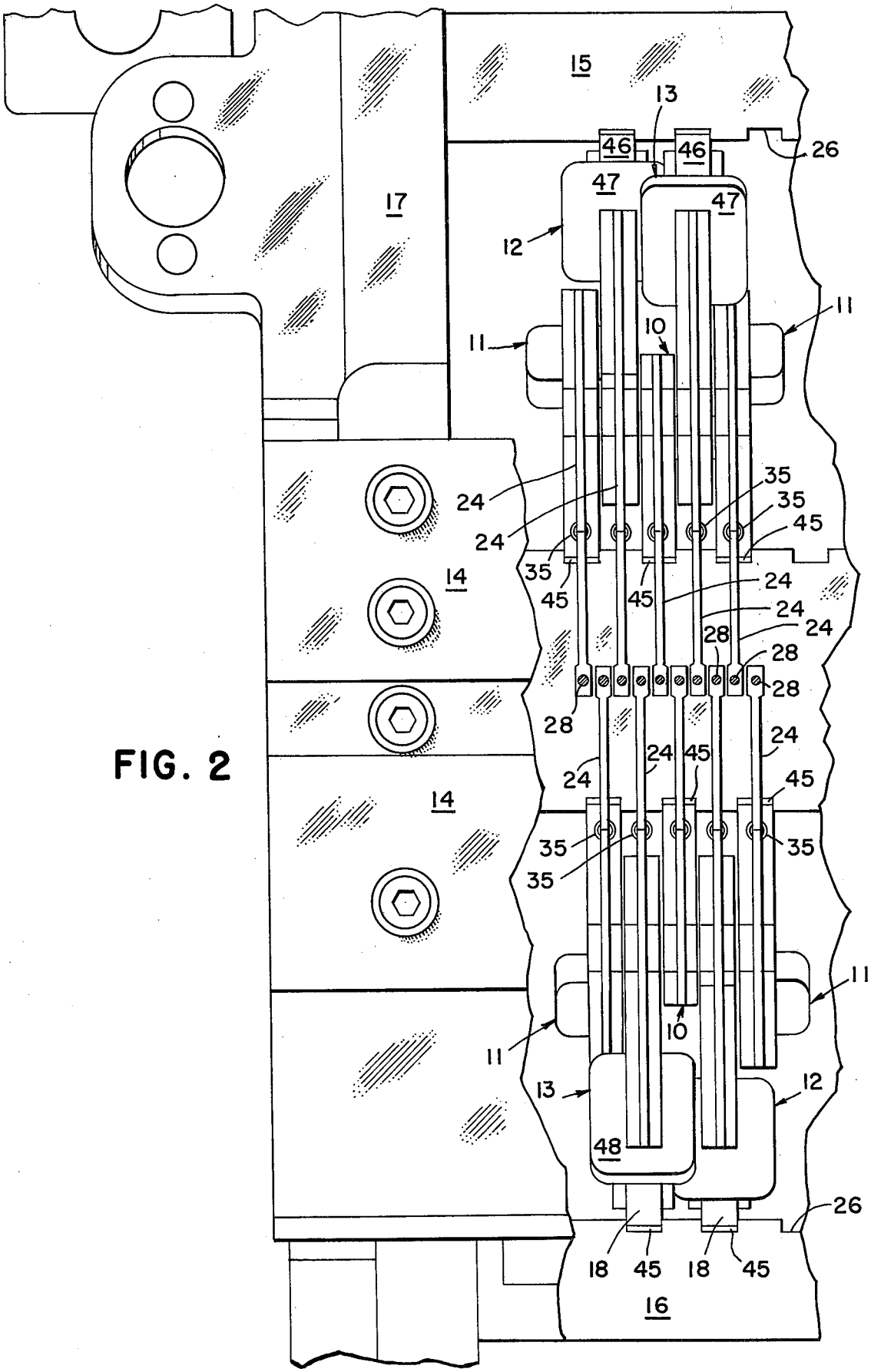
FIG. 2 is a partial side elevation taken at lines 2—2 of FIG. 1.

Referring now to FIGS. 1 and 2, there is shown a preferred embodiment print head frame comprising actuators 10 to 13 mounted on a horizontal web 9 of channel mounting members 14 to 16 which are supported by vertical side members 17. Actuators 10 and 11 are mounted on the horizontal webs 9 of center mounting channel 14. Actuators 12 and 13 are mounted on the upper and lower horizontal webs 9 of mounting channels 15 and 16. The frame portion of the actuators 10 to 13 are shaped differently so that the actuator coils 19 and the moment arms 21 of the actuating levers 22 do not interfere with each other in operation. The arrangement permits the same frame portion 18 to be spaced apart from a similar frame by eight type columns and adjacent pairs of actuators 10 and 11 or 12 and 13 to be separated by four type columns. As best shown in FIG. 2, the actuators mounted on the top of center mounting channel 14 and upper mounting channel 15 have force arm levers 24 driving alternate print hammers. In similar manner the actuators mounted on the lower portion of the center mounting channel 14 and the lower mounting channel 16 have force arm levers 24 for the remaining alternate print hammers.

While the actuators 10 to 13 are mounted on four different horizontal webs 9 of the channel surfaces, and their moment arms are not aligned with each other, the moment arms 21 are the same length. The four actuators 10 to 13 mounted on the upper mounting surfaces have their moment arms 21 aligned on the same upper pivot axis 23. The force arms 24 for the four upper actuators are aligned one with another sharing the same upper pivot axis 23. The four lower actuators 10 to 13 are mounted on two different channel surfaces and have moment arms 21 of equal length arranged in a non-interfering pattern. The moment arms 21 of the four lower actuators 10 to 13 share a common lower pivot axis 25. The cooperating force arms 24 are substantially identical in size and shape and align one with another sharing the lower pivot axis access 25.

Actuators 10 to 13 are placed in their mounting and alignment grooves 26 and are slidably positioned so that the head 27 of the print hammers 28 are flush with the face of the print head mounting frame 29 and the rear of the record media 31 with angular gap 32 closed. When the actuators are in a closed position, with gap 32 closed the print hammer 28 is in the free flight position. Actuators 10 and 11 are shown mounted in their normal or ready or open gap position wherein the print hammers 28 are retracted. Mounting screws 33 extend through oversize apertures 34 in the horizontal webs 9 of mounting channels 14 to 16 to threadably engage and hold the actuator frames 18.

The force arm 24 of the actuating levers 22 are normally held in a retracted position by hammer springs 34 cooperating with print hammers 28 and/or by return springs 35 when provided. The moment arm 21 is normally disengaged from the pole piece 36 by a predetermined angular gap 32. The gap is determined when the actuator is fixed on the mounting channel with the print hammer 28 in the free-flight position. In the normal or open position, the force arms 24 rest on a leaf or tooth 37 of a comb type spring 38. The comb type spring 38 is the vertical web 40 of channel 14 by a series of screws 39, and the individual teeth 37 of the comb 38 are adjustable in and out by means of a fine pitch screw 41 threaded through the vertical web 40 of channel 14. When each screw 41 is advanced, a tooth 37 of the comb opposite the screw 41 is advanced to engage a force arm 24 of one of the actuating levers 22. Advancement of the screw 41 will close the gap 32 thus decreasing the amount of movement of the print hammer 28 before the gap 32 is closed. After the actuators 10 to 13 are assembled in their respective grooves 26 and the print hammers 28 are "run in", the adjustment screws 41 are fine tuned to optimize or correct the flight time of the print hammers 28. The type carrier 42 is moving at speeds approximately 350 inches per second and the flight time of the print hammers is about 600 microseconds. Flight time of the print hammers 28 is normally adjusted to within plus or minus 3 microseconds. Proper flight time will cause the moving type font 43 to be in the exact correct position opposite the print hammer 28 when the record media and ribbon 44 are forced into contact therewith.

Tolerances of all the parts which comprise the actuators 10 to 13 are held very close so that adjustments to the proper flight time coincide with the proper impact force. A print hammer impact force of approximately 30 pounds is achieved at free flight velocities of approximately 200 inches per second. Proper flight time adjustments require that adjustment screws 39 be advanced. Should the gap 32 be insufficient to adjust for the desired proper flight time, shims 45 may be added under the legs 46 of the actuator frame 18.

When the shims 45 shown in FIG. 1 are removed from beneath the actuator 11 the frame 18 of actuator 11 will drop vertically the thickness of the shim 45 removed. Every point on frame 18 moves downward the thickness of the shim. Pivot point 23 and force arm 24 move downward the thickness of the shim removed. Note, that gap 32 moves downward the thickness of the shim but remains unchanged because the force arm 24 is normal to the print hammer 28. In effect the length of the force arm 24 from the pivot point 23 to the point of contact with print hammer 28 has decreased the thickness of the shim 45 removed. Note, that the effective length of the moment arm 21 has remained the same and the gap 32 is also unchanged.

When the actuator 11 is energized the gap 32 completely closes and moves through the same arcuate distance as before the shim was removed. The moment arm 24 will be moved through the same angle of rotation because the gap distance has remained constant, however, the distance of length of arc at the point of contact with the print hammer 28 is now less because the radius defining the arcuate path has been reduced.

Actuator 11, typical of the other actuators, is shown with part of the epoxy protector 47 removed from the coil 19. The heat conductive epoxy is cast in place after the coils 19 and the leads 49 are properly positioned. The heat conductive epoxy protector 47 and the heat conductive frame 18 have sufficient radiant area to dissipate the high heat generated by the toroidal coil 19. The top face of the epoxy protector 51 is established below the top face 52 of the pole piece 36. The pivot arm extension 20 of actuator frame 18 supports pivot pin 23 therein. Actuating levers 22 preferably have Oilite type bearings 55 press fitted in the levers at the pivot points to provide friction free movement.

Figure 3:
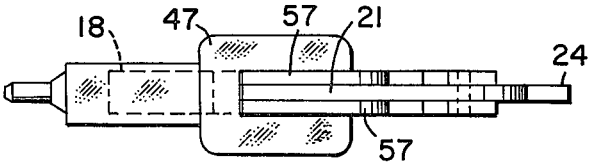
FIG. 3 is a plan view of a preferred embodiment actuator taken at lines 3—3 of FIG. 1.

The return spring 35 is mounted in a hole 56 in the force arm at a point which is approximately halfway between the pivot axis 23 and the end of the lever engaging the print hammers 28. This point lies in the area of maximum bending moment which can exceed 55,000 PSI. Type 455 stainless steel is strong enough to withstand such stresses without incurring fatigue cracks. Plates 57, best shown in FIGS. 2 and 3, are made of relay number five material and are capable of supporting high flux densities. The plates 57 are preferably riveted with flush mounting rivets 58 to the moment arms 21 of the actuating levers 22 to avoid interference with adjacent actuators. Both plates 58 and moment arm 21 are preferably made of uniform thickness material to maintain the lowest possible mass in the moment arm 21 and the force arm 24. Since the actuating lever is made of a high strength-weight ratio material and is designed to operate at high stress loads without incurring fatigue, the mass is about as low as reasonably possible. The moment arm 21 of the actuating lever 22 and the plates 57 attach thereto are both made of high-flux density magnetic material, thus, the mass of the moment arm is kept to a minimum while providing the necessary flux linkage for fast action.

The flux linkage path is shown by the arrows on actuator frame 11.

Having explained a preferred embodiment of the present invention, it will be understood that the actuators disclosed are extremely small but develop very high forces. The print hammers shown in FIG. 2 are normally spaced anywhere from one-sixth to one-tenth of an inch apart, and during normal printing cycles may be actuated as many as 4,000 times per minute when printing speeds are up to 4,000 lines per minute.

What is claimed is:

1. A high speed impact printing mechanism having high energy actuators for driving print hammers which are positioned opposite moving type from a ready position to a free flight position comprising:

a channel mounting means having vertical and horizontal mounting webs, each said actuator having an actuator frame made of high flux density magnetic material mounted on a horizontal web of said channel mounting means, each said actuator frame comprising a pivot mounting arm extension and a pole piece extension integral with said actuator frame and a flux path portion therebetween, a magnetic coil winding wound on said pole piece extension of said actuator frame, a low mass actuating lever comprising a moment arm and a force arm pivotally mounted on said pivot mounting arm extension of said actuator frame, said moment arm being juxtaposed said pole piece extension and separated therefrom by an angular gap when said actuator and print hammer are in said ready position, said force arm being angularly disposed from said horizontal web of said channel mounting means by approximately 90° and positioned opposite said vertical web of said channel mounting means in engagement with one of said print hammers, said actuating lever being made of high flux density high strength magnetic material, a plate of high flux density magnetic material attached to the end of said moment arm juxtaposed said pole piece extension and said flux path portion providing therewith a high flux density path through said actuating lever moment arm, said plate, said pole piece extension, said actuator frame and said flux path portion.

first adjustment screw means extending through an aperture larger than said first adjustment screw means in said horizontal web of said channel mounting means and engaged in said actuator frame for locking said frame on said channel mounting means in a predetermined horizontal position when said moment arm is closed flat against the face of said pole piece extension and said flux path portion with no angular gap to define said free flight position and with a predetermined angular gap to initially set said ready position of said actuator and said print hammer, and second adjustment screw means in said vertical web cooperating with said force arm for making a final critical adjustment of the time of impact of said print hammer with said moving type by adjusting the size of said angular gap and finally setting said ready position of said actuating lever and said print hammer.

2. A high speed impact printing mechanism as set forth in claim 1 wherein said second adjustment screw means comprises an adjustment screw threaded through said vertical web of said channel mounting means and further including a leaf spring having one end mounted on said vertical web of said channel mounting means and the other end interposed between said adjustment screw and said force arm of said actuating lever.

3. A high speed impact printing mechanism as set forth in claim 1 which further includes shim means interposed between said horizontal web of said channel mounting means and said actuator frame for increasing the length of said force arm between the point at which it is pivoted and the point at which it contacts a print hammer while maintaining said angular gap constant whereby the effective length of stroke of the force arm is increased.

* * * * *